US007694749B2

(12) United States Patent
Sorric et al.

(10) Patent No.: US 7,694,749 B2
(45) **Date of Patent: *Apr. 13, 2010**

(54) JACKHAMMER WITH A LIFT ASSIST

(75) Inventors: Ronald Jon Sorric, Warner Springs, CA (US); Ronald William Sorric, Warner Springs, CA (US)

(73) Assignee: Integrated Tool Solutions LLC, San Jacinto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/724,546

(22) Filed: Mar. 15, 2007

(65) Prior Publication Data

US 2007/0240890 A1 Oct. 18, 2007

Related U.S. Application Data

(60) Provisional application No. 60/782,655, filed on Mar. 15, 2006.

(51) Int. Cl.
*B27C 3/08* (2006.01)

(52) U.S. Cl. ..... 173/90; 173/31; 173/170; 173/171; 173/186; 173/19; 173/169

(58) Field of Classification Search ..... 173/31–32, 173/171, 186, 19, 169, 90, 170
See application file for complete search history.

(56) References Cited

U.S. PATENT DOCUMENTS 1,202,551 A 10/1916 MacKenzie
2,622,562 A 12/1952 Longenecker
2,776,653 A * 1/1957 Eaton ..... 254/30
2,874,933 A 2/1959 Feucht
4,548,279 A 10/1985 Zaruba
4,986,370 A 1/1991 Johnson
5,159,860 A * 11/1992 Pietras ..... 81/57.19
6,050,345 A 4/2000 Jarvinen et al.
6,354,080 B1 * 3/2002 Decker ..... 60/412
6,457,624 B1 * 10/2002 Weihrauch ..... 227/10
6,959,760 B1 * 11/2005 Braithwaite et al. ..... 166/177.6
2007/0215368 A1 * 9/2007 Sorric et al. ..... 173/31

* cited by examiner

*Primary Examiner*—Rinaldi I. Rada
*Assistant Examiner*—Michelle Lopez
(74) *Attorney, Agent, or Firm*—The Nath Law Group; Laurie A. Axford

(57) ABSTRACT

The present invention relates to an integrated percussion power tool which contains a percussion mechanism and a lift assist mechanism to reduce the physical demands for its operation by facilitating the lifting and extracting of the percussion power tool. In general, the integrated percussion power tool is a T-shaped machine which has a vertical cylindrical body with two handles, two hand control levers cross the top, and a working tool and a lifting foot on the bottom for engaging with a working surface. The first hand lever is for controlling the operation of the percussion mechanism, whereas the second hand lever is for manipulating the operation of the lift assist mechanism. The percussion mechanism and the lift assist mechanism are both housed in the vertical cylindrical body of the integrated percussion power tool.

7 Claims, 9 Drawing Sheets

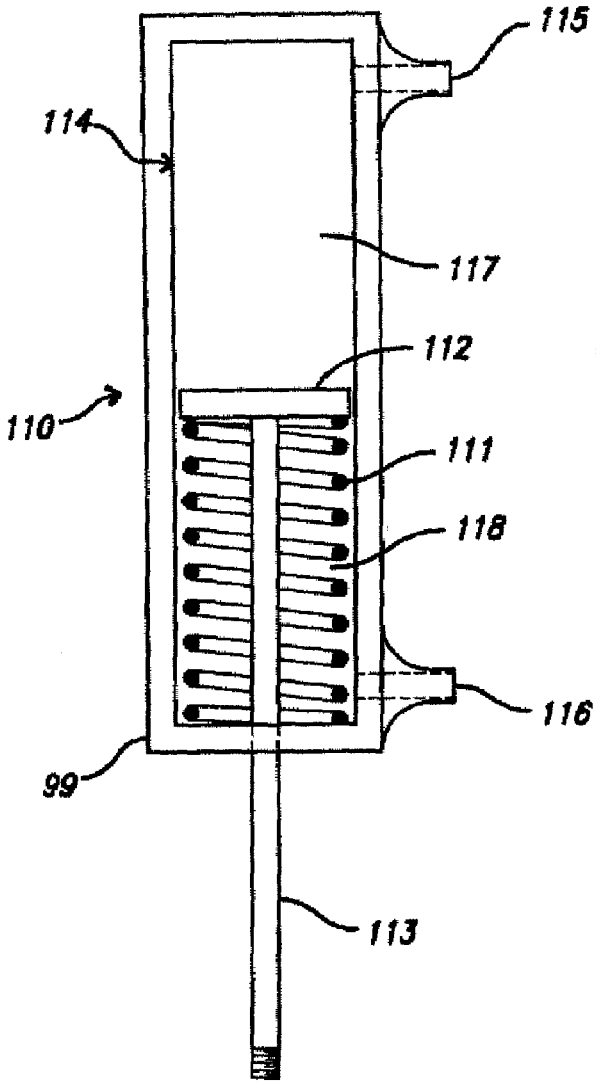
FIG. 6
FIG. 7
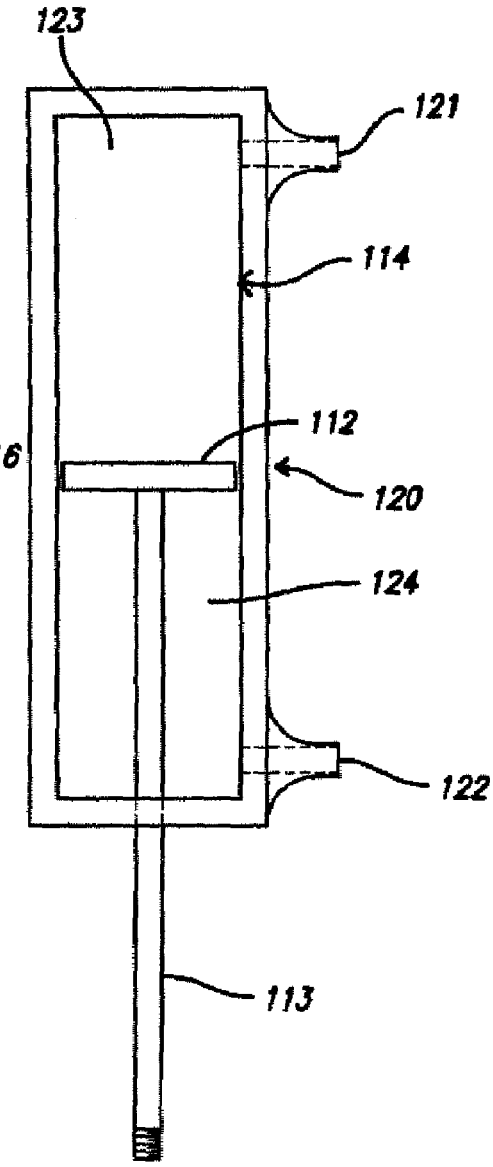

JACKHAMMER WITH A LIFT ASSIST

CROSS-REFERENCE TO OTHER APPLICATION

This application claims the benefit of U.S. Provisional Application No. 60/782,655, filed on Mar. 15, 2006.

TECHNICAL FIELD

The present invention relates to a percussion power tool which contains a lift assist mechanism to alleviate the physical demands for the operation of the heavy percussion power tool by facilitating the lifting and extracting of the percussion power tool from a working surface.

BACKGROUND OF THE INTENTION

A portable percussion power tool such as a pneumatic jackhammer employs a linearly reciprocating piston-driven anvil which rapidly and repeatedly hammers on the end of a chisel bit and impels it into a working surface. Its effectiveness relies on the inertia of the mass of its body and gravity to bring the chisel bit back into contact with the working surface after each blow. As such, the percussion power tool tends to be very heavy, typically having a weight from about 60 to 100 pounds. During a routine operation, an operator is required to repetitively lift and reposition the heavy device for next operation. When working with a tool of such weight, the operator has to endure a great physical stress and is thus prevented from being able to operate the jackhammer for an extended period of time. Furthermore, the chisel bit is also often jammed into the material being worked and requires a great deal of effort to remove, which makes the operation even more physically demanding. As a consequence, it greatly reduces the productivity but also poses a great health-risk to its operators.

Several different types of lift assist devices have been developed to reduce these physical demands by facilitating the lifting and the extracting of the equipment. U.S. Pat. No. 2,622,562 to Longenecker discloses a detachable lift assist device for a percussion power tool, such as a pavement breaker. The lift assist device is a fluid actuated lifting jack which is controlled by a throttle valve with an operating lever adjacent to one of the hand grips of the percussion power tool. When the throttle valve is engaged, actuating media is admitted into the lifting jack and provides forces to lift the percussion power tool. When the throttle valve is disengaged, the actuating media pressure is released, but the piston of the lifting jack remains in contact with the working surface. There is no retracting mechanism provided for the piston of the lifting jack in the disclosure. However, the piston can be manually pushed back to a retracted position.

U.S. Pat. No. 2,776,653 to Eaton discloses an improvement in a pneumatic drill by attaching a pair of pneumatic lifting jacks with a substantially semicircular foot to engage with a working surface for lifting the pneumatic drill. A mechanism is also provided for retracting the lifting foot upon the return of the pneumatic drill to the working position.

U.S. Pat. No. 4,548,279 to Zaruba discloses a demolition tool with an extractor for freeing a jammed demolition tool. The extractor has a pneumatic cylinder with a lifting foot. There is no retracting mechanism provided for the piston in the disclosure. The lifting foot is constantly in contact with the working surface. A flow control valve is provided to regulate the lifting speed.

U.S. Pat. No. 4,986,370 to Johnson discloses a pneumatic lift attachment for a pneumatic jackhammer for applying an upward force to the jackhammer. The lift attachment is a cylinder with a lift foot. The body of the cylinder is enclosed within a support housing which has a lift plate with a guide hole and an adjustable chain for securing a pneumatic hammer to the lift plate. Once engaged, the lifting foot is in constant, contact with the working surface.

U.S. Pat. No. 6,050,345 to Jarvinen et al. discloses an ergonomic tool which includes a jackhammer and a lift assist mechanism. The lift assist mechanism contains a slidable frame with a lifting foot attached to the lower end and a piston attached to the upper end. The piston is directly connected to the upper body of the jackhammer and not movable. The frame which contains a rodless cylinder moves and provides a lifting force to raise the jackhammer.

More than a year ago, the present inventors disclosed a prototype of a lift assist device for a percussion power tool, such, as a pneumatic jackhammer. The lift assist device contains a double acting cylinder with a lifting foot and a commercial four-way directional control valve with five ports. The actuating cylinder and the directional control valve are from commercial sources and supplied as two separate parts. The direction control valve is mounted to the top end of the cylinder using a mounting bracket and the foot is mounted to the bottom end of the cylinder. The lift assist device is then secured to the upper body of the jackhammer using the same mounting bracket. By using a double acting cylinder, the lifting foot may be retracted by redirecting the flow of the compressed air from the upper chamber to the lower chamber to prevent damages to the lift assist device when the percussion power tool is in operation. One significant limitation of this prototype is that the lift assist device is heavy with an overall weight of over 20 pounds, which adds additional unnecessary physical burdens to the operator.

However, all these previous lift assist devices are designed as a separate unit to be attached to the body of a percussion power tool. One disadvantage of such design is that the lift assist device adds additional weight and transportation of such an assembly becomes problematic. One solution to reduce the overall weight of the assembly of the percussion power tool and the lift assist device is to integrate the lift assist device into the body of a percussion power tool. Accordingly, it is an object of the present invention to provide an integrated percussion power tool with a lift assist mechanism.

SUMMARY OF THE INVENTION

In accordance with the present invention, a percussion power tool which contains a percussion mechanism and a lift assist mechanism is provided to reduce the physical demands for its operation by facilitating the lifting and extracting of the percussion power tool. In general, the percussion power tool is a T-shaped machine which has a vertical cylindrical body with two handles, two hand control levers cross the top, and a working tool and a lifting foot on the bottom for engaging with a working surface. The first hand lever is for controlling the operation of the percussion mechanism whereas the second hand lever is for manipulating the operation of the lift assist mechanism.

The percussion mechanism and the lift assist mechanism of the percussion power tool are integrated in the vertical cylindrical body of the percussion power tool. The percussion mechanism has a percussion cylinder which contains a piston within an upper cylindrical bore and a sliding anvil which extends through a lower coaxial cylindrical bore. The working tool with the upper portion being accommodated within the lower cylindrical bore is immediately beneath the sliding anvil.

The lift assist mechanism contains at least one actuating cylinder with at least one lifting foot attached to the outside end of the piston rod and a control unit which comprises a directional control valve. The control unit is on the top of the vertical cylindrical body of the percussion tool whereas the lifting foot is on the bottom to engage with the working surface. The directional control valve is operated using the hand control lever, preferably adjacent to one of the handles of the percussion power tool to simplify its operation.

In one embodiment, the actuating cylinder of the lift assist mechanism is a single acting cylinder with a retracting device such as a bias spring, in which the lower retracting chamber is on the same side as where the retracting device is located and the upper lifting chamber is on the opposite side of a piston.: Preferably, the control valve is a three-way directional control valve. When pressurized actuating media such as compressed air is admitted to the lifting chamber of the cylinder, the piston with the piston rod moves downward against the working surface, thus generating an upward force to raise and free the percussion power tool. During the lifting process, the spring is compressed. Once the directional control valve is switched to the off position, the pressurized actuating media is released from the lifting chamber of the cylinder and the spring forces the piston rod to move upward and retract, thus returning the percussion power tool back to the working surface.

In another embodiment, the actuating cylinder is a dual acting cylinder which has a lifting and retracting chamber. Preferably, the control valve is a four-way directional control valve. When the valve is actuated, pressurized actuating media is directed to the lifting chamber, the piston with the piston rod moves downward against the working surface, thus generating an upward force to raise and free the percussion power tool. During the lifting process, the pressurized actuating media in the retracting chamber is released. When pressurized actuating media is directed to the retracting chamber, the piston rod moves upward and retracts, and the percussion power tool returns to the working surface. During the retracting process, the pressurized actuating media in the lifting chamber is released through an exhaust port on the directional control valve.

In yet another embodiment, the control unit further contains a pressure regulator to control the pressure difference between the lifting and retracting chambers, and thus to adjust the lifting height and the speed of the lift operation under the combined weight of the percussion power tool and the lift assist device.

In yet another embedment, the control unit contains a flow control valve in the place of a pressure regulator. The flow control valve is used to regulate the extension speed of the piston rod and thus the lifting speed for the percussion power tool. The flow control valve may also be used to regulate the retracting speed. Optionally, the control unit, may contain two flow control valves so that the lifting and retracting speeds may be manipulated independently.

In yet another embodiment, the control unit further contains a pressure regulator and a flow control. As such, both the speed and the lifting height may be regulated as discussed hereinabove.

In yet another embodiment, the lift assist mechanism contains two actuating cylinders. The two actuating cylinders are arranged as such that a balance is provided for lifting operation. Preferably, the two actuating cylinders are arranged symmetrically on the two sides of the percussion cylinder. The lift assist mechanism may have only one lifting foot which is connected to the outside end of the piston rod of each actuating cylinder. Alternatively, the assist lift assist mechanism may have two lifting foots such that each actuating cylinder has one lifting foot attached to the outside end of the piston rod.

In yet another embodiment, the percussion power tool further includes a transporting mechanism to assist its transportation. The transporting mechanism contains at least one wheel. The wheel may be the lifting foot or the wheel may be attached to the lower body of the percussion power tool.

BRIEF DESCRIPTION OF THE DRAWINGS

FIG. 6 is a sectional representation of a single acting cylinder with a spring for use in the lift assist mechanism to facilitate lifting and freeing the percussion power tool.

FIG. 7 is a sectional representation of a double acting cylinder for use in the lift assist mechanism to facilitate lifting and freeing the percussion power tool.

DETAILED DESCRIPTION OF THE INVENTION

Figure 1:
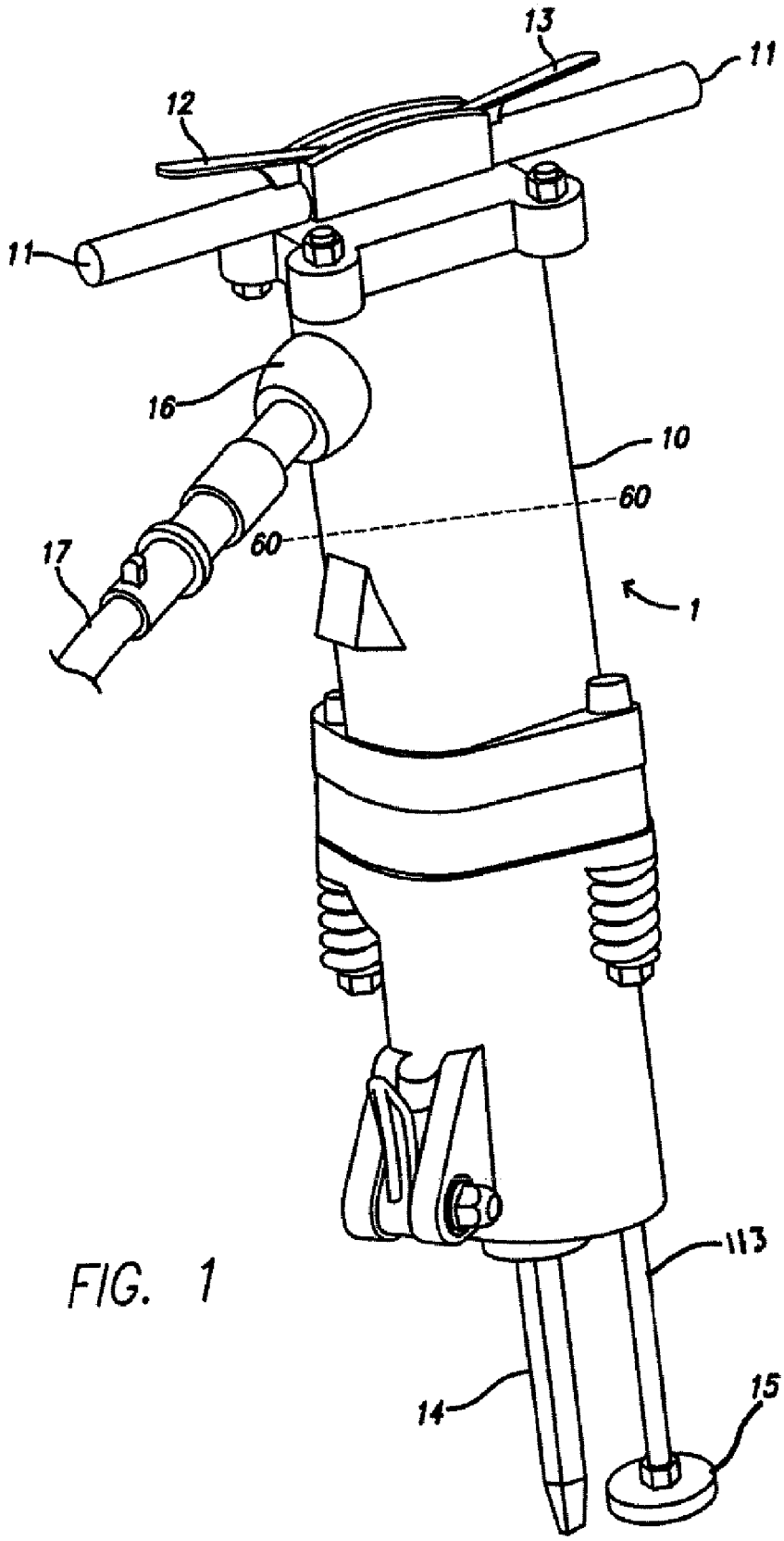
FIG. 1 is a perspective view of a percussion power tool with a lift assist mechanism having a single actuating cylinder.
Figure 2:
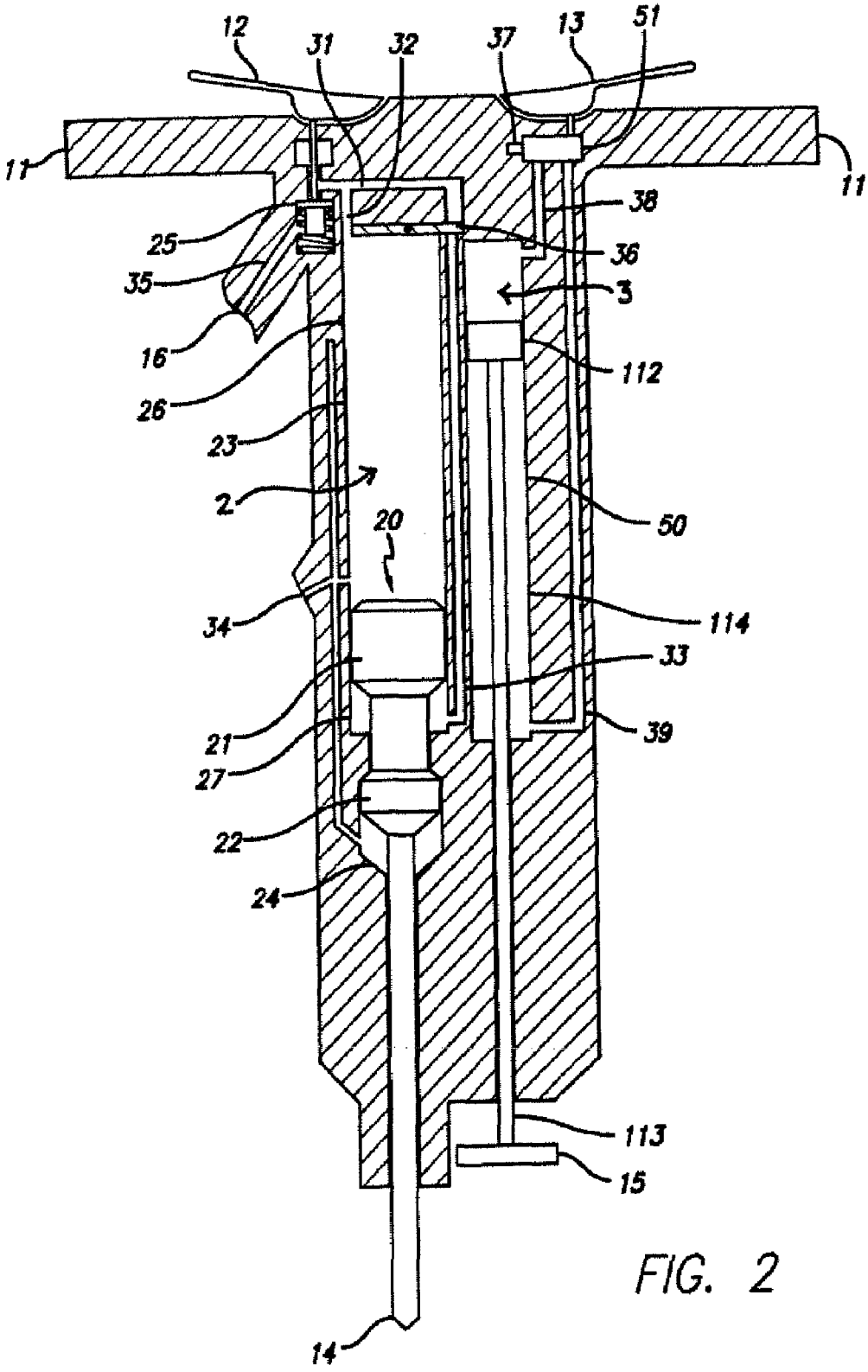
FIG. 2 is a cross-sectional view of a percussion power tool with a lift assist mechanism having-a single actuating cylinder.

The present invention relates to a percussion power tool 1 which contains a percussion mechanism 2 and a lift assist mechanism 3 (FIG. 1 and 2). The percussion power tool 1 is typically a jackhammer or a rock drill, which is used to break up rock, concrete, road pavement such as asphalt and macadam, and earth. The lift assist mechanism 3 is used to alleviate the physical demands for the operation of the heavy percussion power tool 1 by facilitating the lifting and extracting.

In general, the percussion power tool 1 is a T-shaped machine ruggedly constructed in a variety of weights to suit a particular application (FIG. 1). Similar to a conventional jackhammer, the percussion power tool 1 has a vertical body which, in one embodiment, is a vertical cylindrical body 10 with two handles 11 and two hand control levers (12 and 13) cross the top. It is to be understood, however, that the vertical body is not necessarily cylindrical in other embodiments of the invention. On the bottom, the percussion power tool 1 has a working tool 14, such as a chisel or a drill, and a lifting foot 15. Preferably, the percussion mechanism 2 and the lift assist mechanism 3 are integrated into a single vertical cylindrical body 10, which houses a percussion cylinder 20 for the percussion mechanism 2 and at least one actuating cylinder 50 for the lift assist mechanism 3, (FIG. 2). The first hand control lever 12 is connected to a throttle valve 25 for controlling the operation of the percussion mechanism 2. The second hand control lever 13 is connected to a control unit 51 for manipulating the operation of the lift assist mechanism 3. Preferably, the first hand lever 12 is adjacent to one handle 11 whereas the second hand lever 13 is adjacent to the other handle 11.

Both percussion mechanism 2 and the lift assist mechanism 3 may be energized by various types of powers, including pneumatic, hydraulic, and electrical powers, independently or together. Preferably, both the percussion mechanism 2 and the lift assist mechanism 3 are powered by a single source of actuating media, such as compressed air. Typically, pressurized actuating media is fed in through a flexible hose 17 from the source of pressurized actuating media to an actuating media port 16, which is located on the upper portion of the vertical cylindrical body 10 and below the handle 11, to provide power for both the percussion mechanism 2 and the lift assist mechanism 3.

The percussion mechanism 2 of the present invention may have various configurations to suit a particular application, such as a jackhammer, which is also known as a paving breaker, and a rock drill. In an exemplary embodiment (FIG. 2), the percussion mechanism 2 is powered by a percussion cylinder 20, which is housed inside the vertical cylindrical body 10. The percussion cylinder 20 contains a piston 21 within an upper cylindrical bore 23 and a sliding anvil 22 which extends through a lower cylindrical bore 24. The upper and lower cylindrical bores, 23 and 24, are coaxial to each other. The working tool 14 is located under the sliding anvil 22, with the upper portion being accommodated within the second cylindrical bore 24 and the lower end being adapted to strike a working surface. The working tool 14 is removably attached to the bottom of the percussion power tool 1.

To actuate the piston 20, an actuating media distribution system is provided in the walls of the vertical cylindrical body 10, including a main duct 31 in the upper end wall of the vertical cylindrical body 10, which is connected to the source of pressurized actuating media through a throttle valve 25 and a duct 35. The throttle valve 25 is controlled by the hand control lever 12. Also provided are the branched ducts 32 and 33 through which actuating media is transported to the upper chamber 26 and lower chamber 27 of the cylindrical bore 23, respectively. A switch mechanism 36 is also provided to control the flow of actuating media by alternatively closing off the branched ducts 32 and 33. An exhaust duct 34 is provided in the side wall of the vertical cylindrical body 10, which is connected to both cylindrical bores 23 and 24 with ambient air or the atmosphere, for releasing pressures in the cylindrical bores 23 and 24 during operation.

In a normal operation, pressurized actuating media first enters the upper chamber 26 of the cylindrical bore 23 through the branched duct, 32. The actuating media pressure forces the piston 21 down onto the sliding anvil 22. The energy of the piston 21 hitting the anvil 22 is then transferred onto the working tool 14 beneath, which is in turn struck down onto the working surface. Once the piston 21 hits the anvil 22, the switch mechanism 36 is switched to shut off the flow of actuating media to the upper chamber 26 of the cylindrical bore 23 by closing off the branched duct 32 and to redirect the flow to the lower chamber 27 by opening the branched duct 33. The actuating media pressure then drives the piston 21 back to the top of the cylindrical bore 23. At the same time, the pressure in the upper chamber 26 of the cylinder bore 23 is reduced by releasing the media in the upper chamber 26 through the exhaust duct 34. Once the piston 21 reaches to the top, the switch mechanism 36 automatically reverses itself and redirects the flow to the upper chamber 26 of the cylindrical bore 23 and the piston 21 is force down the cylindrical bore 23 to strike the anvil 22 and the working tool 14 again. This sequence is repeated over and over as long as the hand control lever 12 is depressed.

To minimize wear on the moving anvil 22 and piston 21, pressurized actuating media is normally lubricated by an oil valve fed from a reservoir (not shown), which may be located in one of the handles 11. Further reduction in wear may be achieved by the design of air cushions at the top and the bottom of the percussion cylinder 20 to prevent the piston 21 hitting the ends of the cylinder 20.

Figure 3:
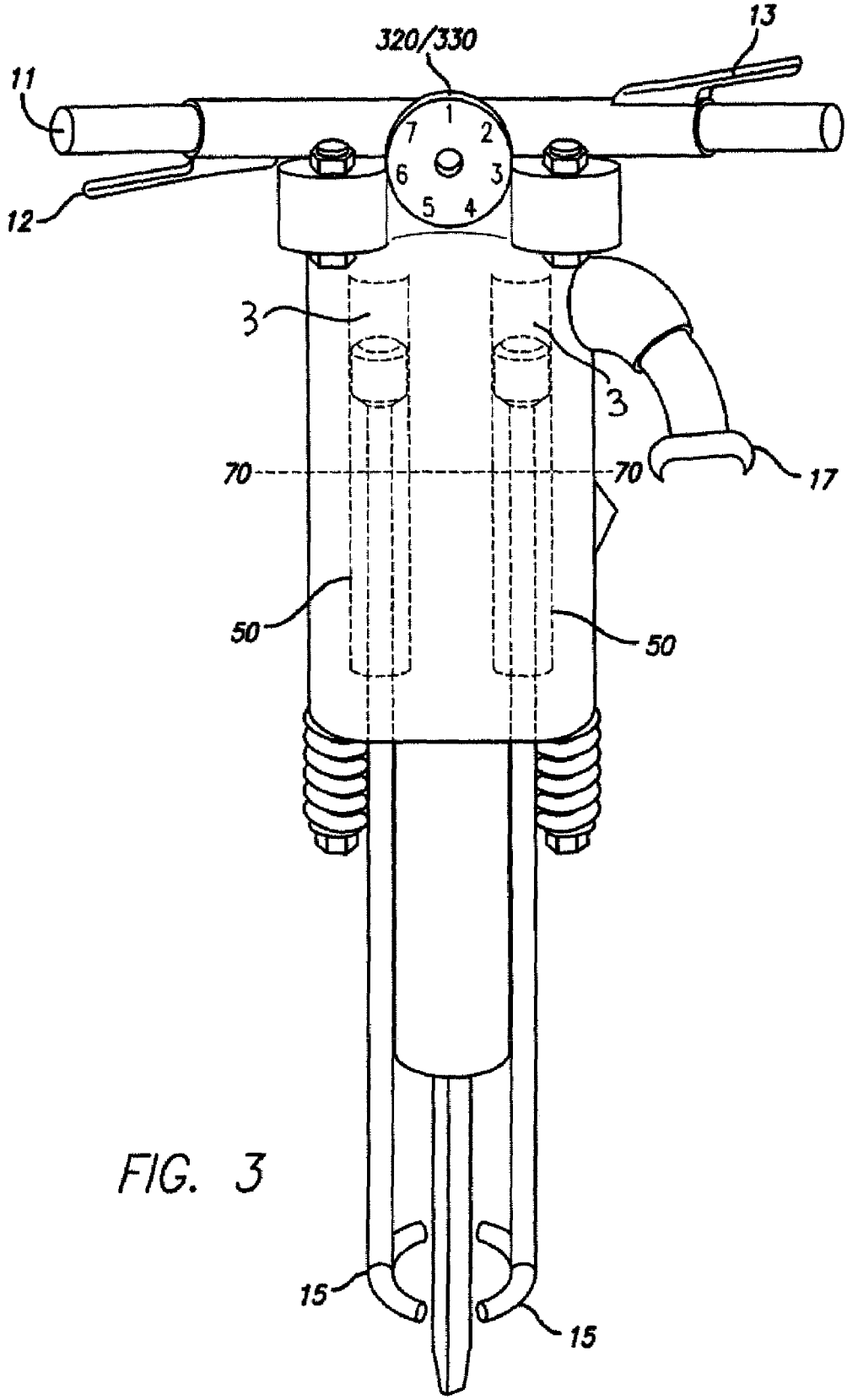
FIG. 3 is a perspective view of a percussion power tool with a lift assist mechanism having two actuating cylinders.
Figure 4:
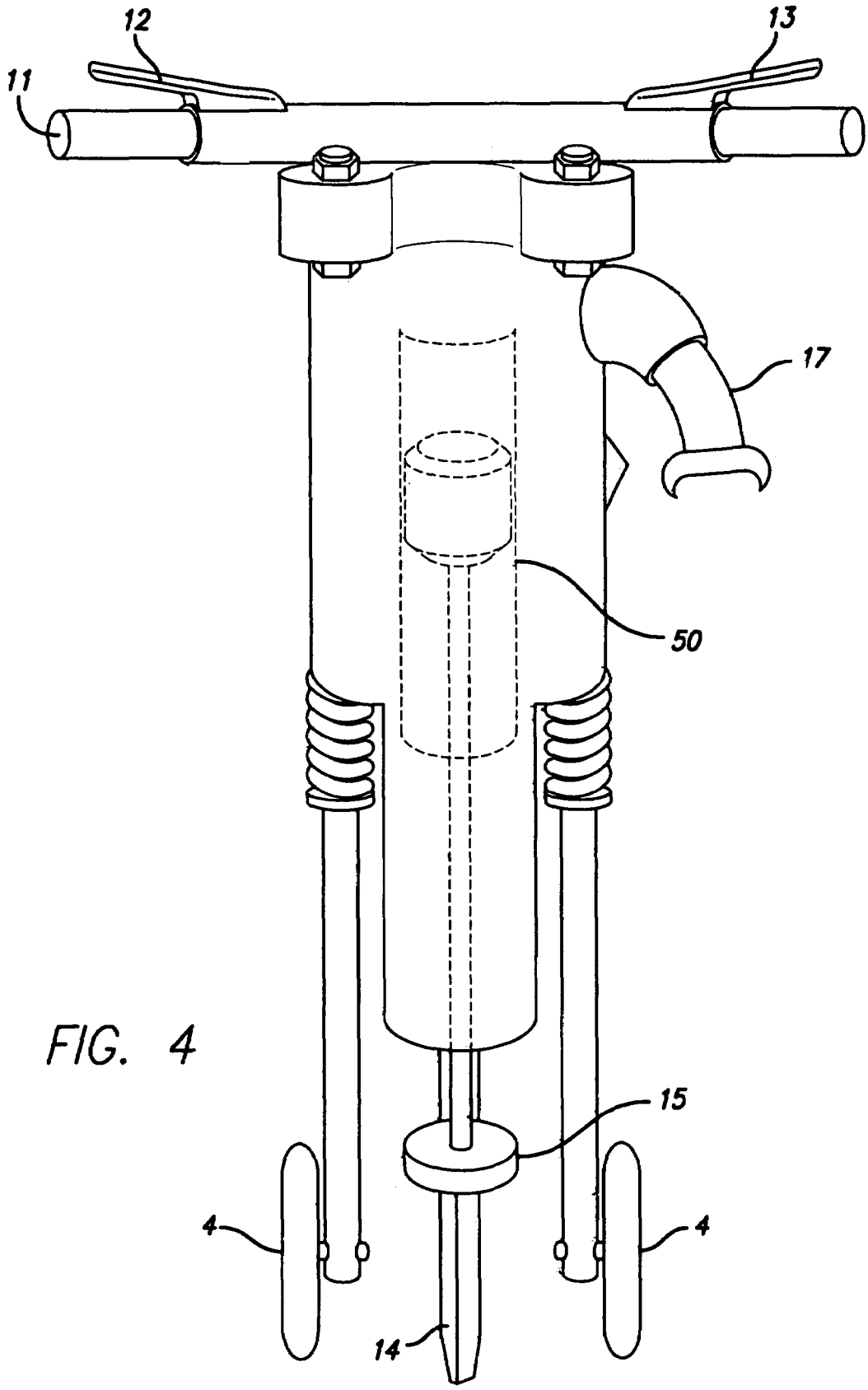
FIG. 4 is a perspective view of a percussion power tool with a lift assist mechanism having a single actuating cylinder and a transporting mechanism which contains two wheels attached to the lower cylindrical body of the percussion power tool.

In the present invention, the lift assist mechanism 3 of the percussion power tool 1 may also have various configurations as shown in FIGS. 1, 3 and 4. The lift assist mechanism 3 contains at least one actuating cylinder 50 and a control unit 51 on the top the vertical cylindrical body 10 (FIG. 2). The control unit 51 contains at least a directional control valve 311 or 312. Preferably, the actuating cylinder 50 is housed inside the vertical cylindrical body 10 and is parallel to the percussion cylinder 20. The actuating cylinder 50 contains a ram or piston 112 with a top and bottom, operating within a cylindrical bore 114 (FIG. 2). As used herein, the terms "ram" and "piston" are interchangeable without distinguishing. Furthermore, the cylinder 50 contains a piston rod 113 with a top and bottom end. The top end of the piston rod 113 is attached to the piston 112 whereas the bottom end is optionally connected to the lifting foot 20. The lifting foot 15 may be secured to the piston rod 113 with a pin or a set screw. The lifting foot 15 may also be securely screwed onto the piston rod 113 with a threaded end. The lifting foot 15 may be in various forms and shapes, including, but not limited to, bars, dishes, cylinders, or wheels. The actuating cylinder 50 converts the power of actuating media to linear force and moves the lifting foot 15 up and down.

Figure 5:
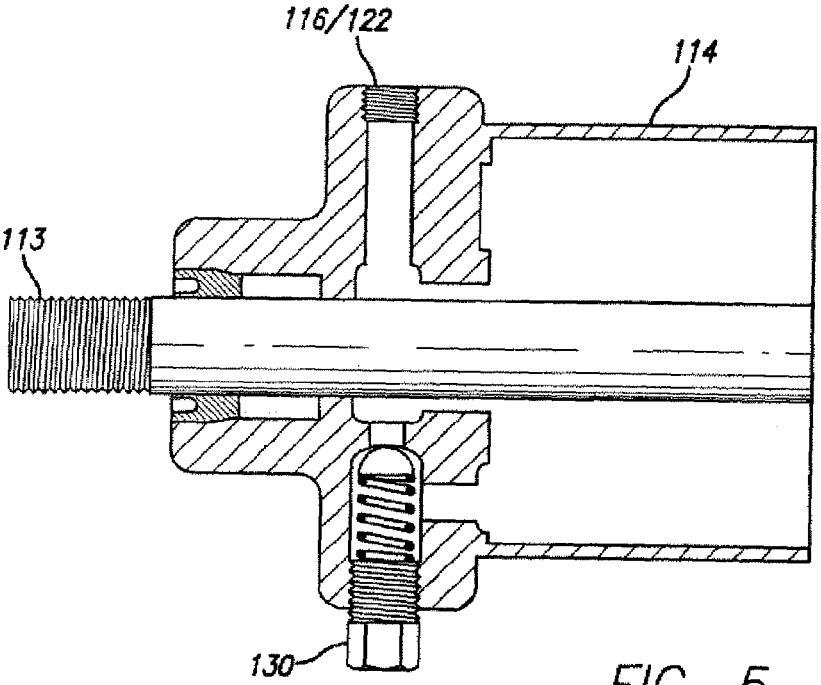
FIG. 5 is an expanded sectional view of an actuating cylinder.

The actuating cylinder 50 may be located in various positions relative to the percussion cylinder 20 within the vertical cylindrical body 10. Preferably, the lower end of the actuating cylinder 50 is close to the lower end of the vertical cylindrical body 10 so that the length of the piston rod 113 of the actuating cylinder 50 is minimized. The actuating cylinder 50 may also have various sizes of bore and various lengths of stroke. The actuating cylinder 50 may have an inside diameter of from about 0.2 to about 10 inches or from about 0.5 to about 5 inches with the preferred diameter of from about 2.0 to about 2.75 inches. Furthermore, the actuating cylinder 50 may have a length of from about 2 to about 30 inches or from about 5 to about 25 inches with the preferred length of from about 18 to about 20 inches. The stroke of the actuating cylinder 50 may have a length of from about 1 to about 25 inches or from about 3 to about 20 inches with the preferred length of from about 16 to about 18 inches. Also, various types of piston mounting members may be used to enhance the performance and prolong the life. For example, an adjustable cushion 130 may be provided to facilitate smooth stopping of the piston movement (FIG. 5).

A variety of actuating cylinders may be used in the present invention, including single acting and double acting cylinders. In one aspect, the actuating cylinders 50 of the lift assist mechanism 3 is a single acting cylinder 110 which contains a retracting device 111 such as a bias spring, a piston 112, and a piston rod 113, all disposed within a longitudinal bore 114

(FIG. 6). The body of the cylinder 110 also contains an actuating media port 115 and an air port 116. Preferably, the spring 111 is a compression spring and located on the same side as where the piston rod 113 is located, as shown in FIG. 6. In an alternative embodiment, the spring 111 is a tension spring and located on the other side of the piston 112. The cylindrical bore 114 is thus naturally divided by the piston 112 into two chambers, a lifting chamber 117 and a retracting chamber 118 where the spring 111 is located. The actuating media port 115 is located on the lifting chamber 117, which is on the opposite side of the spring 111, whereas the air port 116 is located on the retracting chamber 118. The single acting cylinder 110 uses actuating media pressure to provide the force in one direction to extend the piston rod 113 and spring tension in the opposite direction to retract the piston rod 113.

Figure 8A:
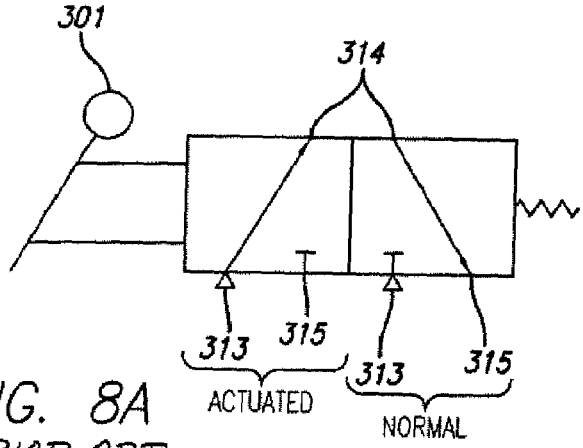
FIG. 8A PRIOR ART
FIGS. 8A, 8B and 8C are a schematic view, a side view, and a top view of a prior art three-way directional control valve with two positions, respectively.
Figure 8C:
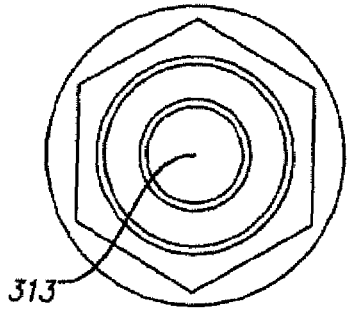
FIG. 8C PRIOR ART
Figure 8B:
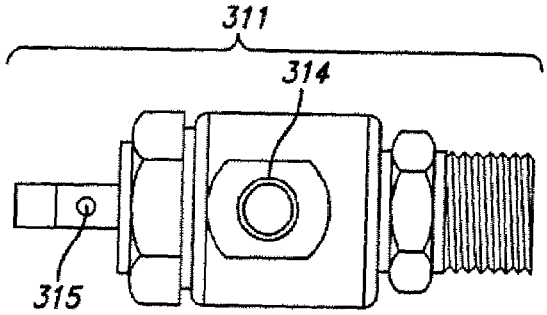
FIG. 8B PRIOR ART

A three-way directional control valve 311 is normally used to control the operation of the single acting cylinder 110 (FIG. 8). Generally, the directional control valve 311 has an inlet port 313, an outlet port 314, and an exhaust port 315. To actuate the piston 112, an actuating media distribution system is provided in the walls of the vertical cylindrical body 10, including an inlet duct 37 in the upper end wall of the vertical cylindrical body 10, a media transporting duct 38, and an exhaust duct 39. One end of the inlet duct 37 is connected through the duct 35 to the source of pressurized actuating media and the other end is connected to the inlet port 313 of the directional control valve 311. The media transporting duct 38 is connected to the outlet port 314 on one end and to the actuating media port 115 on the other end. The exhaust duct 39 is connected to the air port 116 on one end and to the main exhaust duct 34 on the other end.

To extend the piston rod 113, pressurized actuating media, such as compressed air, is directed through the actuating media port 115 into the lifting chamber 117 of the cylinder 110 through the duct 38. The pressure acts on the top surface of the piston 112, pushing the piston 112 down with the piston rod 113 and foot 15 against the working surface to raise the percussion power tool 1. During the lifting process, the spring 111 is compressed between bottom side of the piston 112 and the bottom of the cylindrical bore 114.

To retract the piston rod 113, the directional control valve 311 is switched to the off position, releasing the pressure in the lifting chamber 117 of the cylinder 110. The spring tension forces the piston 112 to move upward, thus retracting the piston rod 113. The actuating media is free to flow from the lifting chamber 117 through the actuating media port 115 and the duct 38, back through the control valve 311 to the return line in hydraulic systems or to the atmosphere in pneumatic systems. Typically, the air port 116 of the cylinder 110 is vented to the atmosphere through the ducts 39 and 38 for exhausting air from the retracting chamber when the piston moves down and for intaking air into the retracting chamber when the piston moves up.

In certain embodiments, the three-way directional control valve 311 has two positions, i.e., normal and actuated positions. When the valve 311 is in actuated position, the inlet port 313 and outlet port 314 is connected and thus pressurized actuating media flows into the lifting chamber 117 to push the piston 112 down with the piston rod 113 and foot 15 against the working surface to raise the percussion power tool 1. When the valve 311 is in normal position, the inlet port 313 is blocked, the outlet port 314 is connected to the exhaust port 315, thus pressurized actuating media is released from the lifting chamber 117 and the spring tension forces the piston 112 to move upward to retract the piston rod 113.

In another aspect, the actuating cylinder 50 of the lift assist mechanism 3 is a double acting cylinder 120 in which pressurized actuating media may be applied to either side of the piston 112 to apply force and provide both upward and downward movement (FIG. 7). Typically, the cylinder 120 contains one piston 112 and one piston rod 113, both disposed within a longitudinal bore 114. The stroke of the piston 112 and piston rod 113 in either direction is produced by actuating media pressure. The cylinder 120 also contains two actuating media ports (121 and 122), one near each end of the cylinder, alternate as inlet port and outlet port, depending on the direction of flow as controlled by the directional control valve. When an unbalanced actuating cylinder 120, which has two different effective working areas on the two sides of the piston 112, is used, the cylinder 120 is normally installed so that the blank side of the piston 120, which carries the greater load during the piston rod extension stroke, is used for lifting. The cylindrical bore 114 is also-divided by the piston 112 into two chambers with the lifting chamber 123 on top and the retracting chamber 124 on bottom.

Figure 9A:
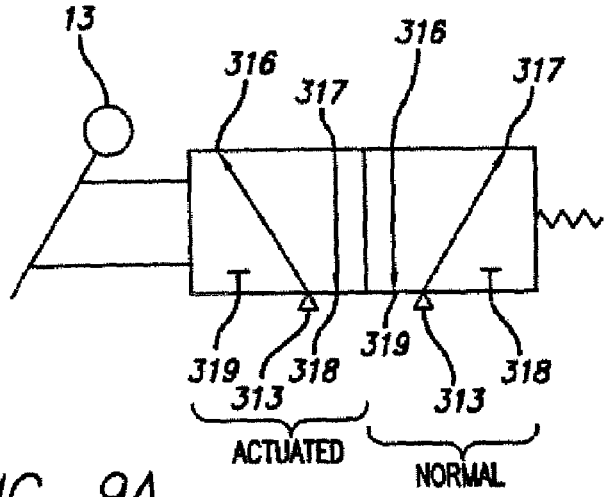
FIG. 9A PRIOR ART
FIGS. 9A and 9B are schematic representations of prior art two and three position control valves, respectively.
Figure 10A:
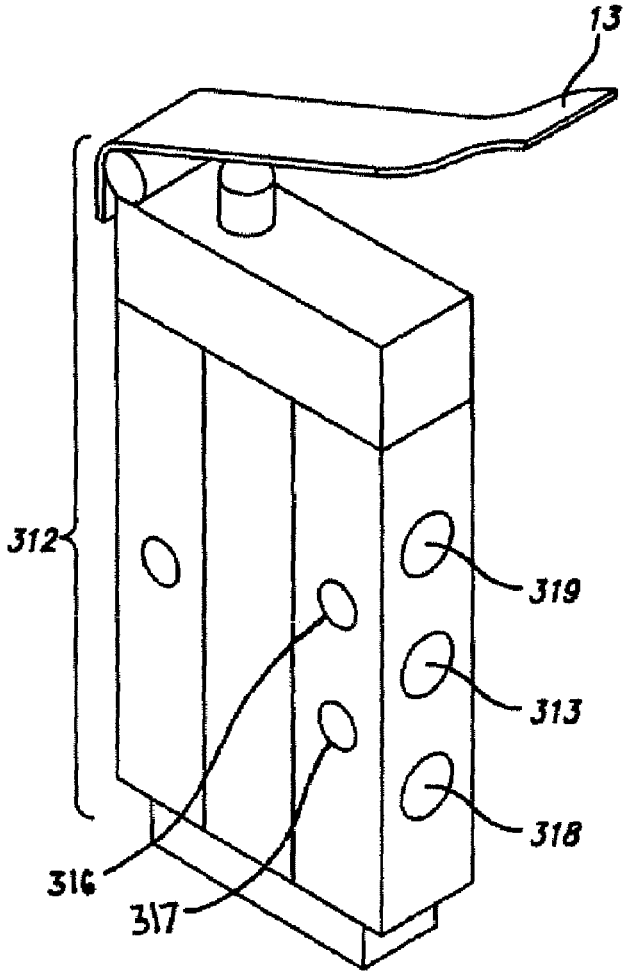
FIG. 10A PRIOR ART
FIGS. 10A and 10B are perspective views of prior art four-way directional control valves with three positions.
Figure 9B:
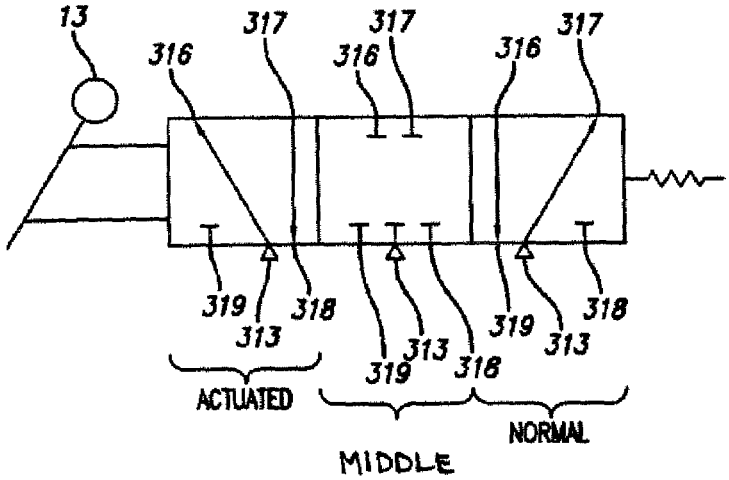
FIG 9B PRIOR ART

A four-way directional control valve 312 is normally used to control the operation of the double acting cylinder 120 (FIGS. 9A and 9B). Generally, the directional control valve 312 has five ports, i.e., inlet port 313, outlet ports 316 and 317, and exhaust ports 318 and 319. To actuate the piston 112, an actuating media distribution system is provided in the walls of the vertical cylindrical body 10, including an inlet duct 37 in the upper end wall of the vertical cylindrical body 10, two media transporting ducts 38 and 39. One end of the inlet duct 37 is connected through the duct 35 to the source of pressurized actuating media and the other end is connected to the inlet port 313 of the directional control valve 312. The media transporting duct 38 is connected to the outlet port 316 on one end and to the actuating media port 121 on the other end. The exhaust duct 39 is connected to the actuating media port 122 on one end and to the outlet port 317 on the other end.

In certain embodiments, the directional control valve 312 has two positions, normal and actuated positions (FIG. 9A). The directional control valve 312 may be positioned to direct pressurized actuating media to either end of the cylinder 120 and allows the displaced actuating media to flow from the opposite end of the cylinder 120 through the control valve 312 to the return line in hydraulic systems or to the atmosphere in pneumatic systems. When the valve 312 is in actuated position, the inlet port 313 is connected to the outlet port 316 and thus the pressurized actuating media flows into the lifting chamber 123 to push the piston 112 down with the piston rod 113 and foot 15 against the working surface to raise the percussion power tool 1. At this position, the outlet port 317 is also connected to the exhaust port 318 to release the actuating media from the retracting chamber 124. When the valve 312 is in normal position, the inlet port 313 is connected to the outlet port 317 and thus pressurized actuating media flows into the retracting chamber 124 to withdraw the lifting foot 15. At this position, the outlet port 316 is connected to the exhaust port 319 to allow the release of actuating media from the lifting chamber 123.

Figure 10B:
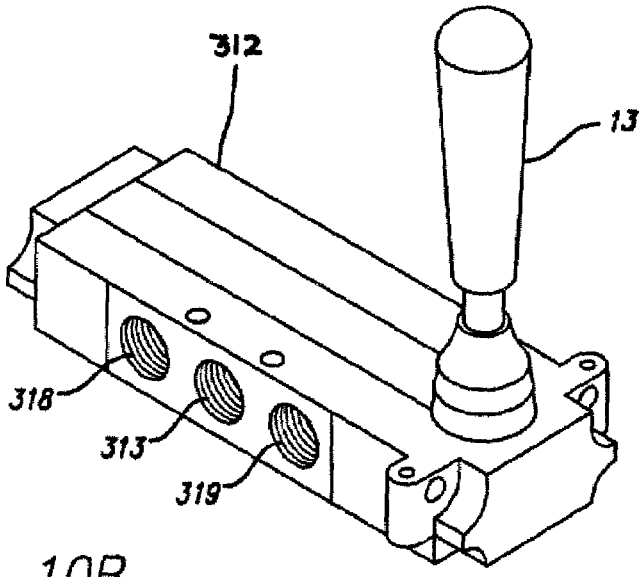
FIG. 10B PRIOR ART

In certain embodiments, the directional control valve 311 or 312 has three positions, an actuated position for lifting, a middle position, and a normal position for retracting (FIG. 9B). Examples of a four-way, directional valve 312 are illustrated in FIGS. 9B and 10B. The actuated position is for admission of actuating media to the lifting chamber (117 or 123), whereas the normal position is for the release of actuating media from the lifting chamber (117 or 123). The middle position maintains the pressure of the lifting chamber (117 or 123) equal to the pressure in the retracting chamber (118 or 124) and after the piston rod 113 with the lifting foot 15 is extended. At this position, no actuating media gets in or out of the cylinder 50, and the percussion power tool 1 may be readily transported when the lifting foot 15 is a wheel and the like (not shown). Alternatively, the percussion power tool 1 has a transporting mechanism 4 as shown in FIG. 4.

In certain embodiments, the control unit 51 of the lift assist mechanism 3 further contains a pressure regulator 320 for manipulation of the traveling distance (extension) of the piston rod 113, thus the lifting height under the weight of the percussion power tool 1. As used herein, the term "pressure regulator" also includes a pressure reducing valve which provides a steady pressure at a lower pressure at the supply system. Preferably, the pressure regulator 320 is used to regulate the maximum pressure of the lifting chamber. The pressure regulator 320 may be located between the actuating media port (115 or 121) of the lifting chamber (117 or 123) and the directional control valve 310, or before the directional control valve 311 or 312. When the cylinder 50 is a double acting cylinder 120, the pressure regulator 320 is preferably located before the directional control valve 311 or 312 so that the pressures of both chambers may be regulated. In operation, the pressure may be adjusted to such level that a desired lifting height is reached for a particular application under the weight the percussion power tool 1. The lifting height is determined by the weight of the percussion power tool 1 and the difference in pressure between the two chambers. The greater the difference in pressure, the longer the foot travels.

In certain embodiments, the control unit 51 contains a flow control valve 330 in the place of a pressure regulator 320. The flow control valve 330 is used to regulate the extension speed of the piston rod 113 and thus the lifting speed. The flow control valve 330 may be arranged either before the directional control valve 311 or 312 or after. When the flow control valve 330 is located prior to the directional control valve 311 or 312, the lifting and retracting speeds may be adjusted for a double acting cylinder 120 is used. When the flow control valve 330 is located after the directional control valve 311 or 312, only the lifting speed is adjustable. In this case, an optional flow control valve may be added to regulate the retracting speed independently for a double acting cylinder 120.

In certain embodiments, the control unit further contains a pressure regulator 320 and a flow control 330. As such, both the speed and the lifting height are regulated as discussed hereinabove.

The percussion power tool 1 of the present invention is a combination of the percussion mechanism 2 and the lift assist mechanism 3. In one embodiment, the lift assist mechanism 3 of the percussion power tool 1 contains one actuating cylinder 50 and a control unit 51. The lifting foot 15 may also be in various locations relative to the operator of the percussion power tool 1, which is determined by the relative positions of the percussion cylinder 20 verse the lift assist cylinder 50. Some non-limiting exemplary configurations are shown in FIGS. 11A, 11B, 12A, and 12B. Preferably, the lifting foot 15 is the configuration of FIG. 12A. As such, the lifting foot 15 is in between the operator and the percussion power tool 1.

Figure 11A:
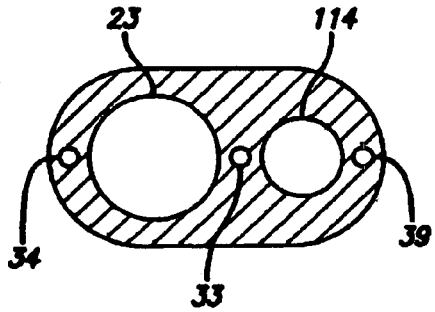
FIGS. 11A, 11B, 12A, and 12B are cross-sectional views of alternative configurations of the percussion cylinder and the lift assist cylinder of the percussion power tool along the line 60-60 in FIG. 1.
Figure 11B:
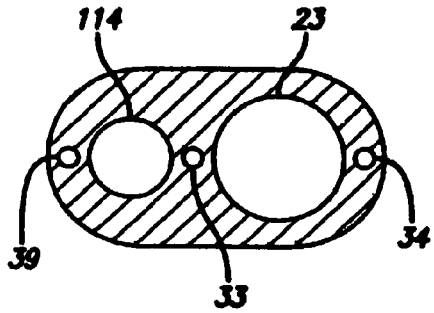
Figure 11C:
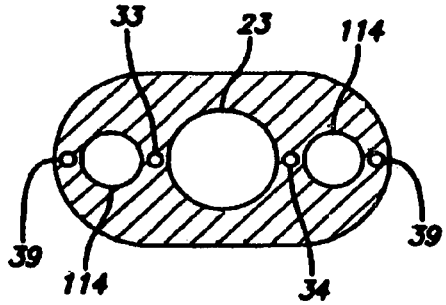
FIGS. 11C and 11D are cross-sectional views of alternative configurations of the percussion cylinder and the two lift assist cylinders of the percussion power tool along the line 70-70 in FIG. 3.
Figure 11D:
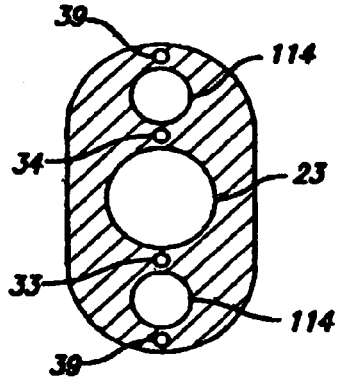
Figure 12A:
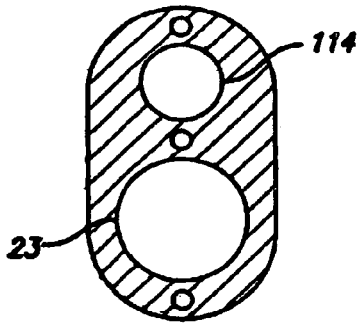
Figure 12B:
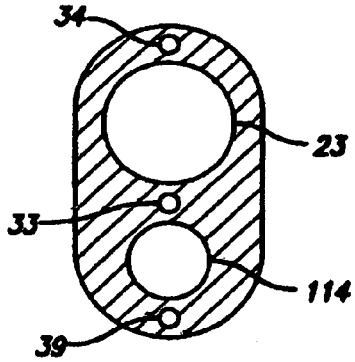

In another embodiment, the lift assist mechanism 3 contains two actuating cylinders 50 and the control unit 51. Preferably, the two actuating cylinders 50 are configured as such that a balance is provided during lifting process. For example, the two actuating cylinders 50 may be arranged symmetrically on the two sides of the vertical cylindrical body 10 of the percussion power tool 1 (FIGS. 11C and 11D). The lift assist mechanism 3 may have a single lifting foot 15 connected to the outside end of the piston rod 113 of each actuating cylinder 50. Alternatively, the assist lift assist mechanism 3 may have two lifting feet 15, each attached to the outside end of the piston rod 113 of each actuating cylinder 50.

In yet another embodiment, the percussion power tool 1 further includes a transporting mechanism (not shown) to assist the transportation of the percussion power tool 1. In one aspect, the lifting foot 15 is a wheel.

The percussion power tool 1 of the present invention may have various heights and dimensions to suit for a particular application. In one aspect, the percussion power tool 1 has a weight of no greater than 200 pounds, no greater than 180 pounds, no greater than 160 pounds, no greater than 140 pounds, no greater than 120 pounds, no greater than 110 pounds, or no greater than 100 pounds. In another aspect, the cylindrical body of the percussion power tool 1 has a width of no greater than about 16 inches, no greater than about 12 inches, no greater than 10 inches, no greater than 9 inches, or no greater than 8 inches. In yet another aspect, the body of the percussion power tool 1 without a working tool attached has a height of no greater than about 40 inches, no greater than about 38 inches, no greater than 36 inches, no greater than inches 34, or no greater than 32 inches.

The percussion power tool 1 with the lift assist mechanism 3 may be operated under a wide range of pressure, from about 50 to 200 psi. A typical operating pressure is from about 70 to about 120 psi, most commonly about 90 psi. Normally, the percussion power tool 1 is operable in a temperature range of from −40 to 70° C. The percussion power tool 1 may have a variety of weights, from 1 to 200 pounds, 5 to 150 pounds, or 10 to 120 pounds. The percussion mechanism 2 and the lift assist mechanism 3 may operate at different pressures, but preferably at a similar pressure. Similar to a commercial jackhammer, the percussion mechanism may operate at a pressure of about 85 psi and vary in consumption from 1.1 to 2.1 $m^3$ of air per minutes, producing 1100 to 1500 blows per minute.

One skilled in the art will understand that various modifications may be made to the above embodiments which are still within the scope and spirit of the invention described herein. The above description should not be construed as limiting but merely as exemplifications of the preferred embodiments of the invention.

What is claimed is:

1. An integrated percussion power tool and lift assist, comprising:

a single vertical body comprising at least two integral longitudinal bores, wherein a first integral longitudinal bore is a percussion bore and wherein a second integral longitudinal bore is a first actuating bore;

a percussion piston contained within the percussion bore of the single vertical body;

a first lift piston contained within the first actuating bore of the single vertical body and dividing the first actuating bore into an upper lifting chamber and a lower retracting chamber; and a first lift piston rod connected to the first lift piston and extending out of the first actuating bore through an opening in the lower retracting chamber and extending out of the single vertical body through an opening in the single vertical body, wherein the first lift piston rod further comprises an outside end;

a lifting foot connected to the outside end of the first lift piston rod;

a control unit comprising a directional control valve having an on position and a normal position; and a piston retractor arranged to provide a force against the first lift piston in an upward direction away from the lower retracting chamber and towards the upper lifting chamber to thereby keep the lifting foot maintained in a retracted position when the control valve is in the normal position;

wherein actuation of the control valve releases said force against the first lift piston to push the first lift piston down with the first lift piston rod and the lifting foot against a working surface to raise the integrated percussion power tool and lift assist from the working surface, thereafter switching the control valve to the normal position to force the piston rod and lifting foot back to the upward and maintained retracted position, thus returning the percussion power tool to the working surface.

2. The integrated percussion power tool and lift assist of claim 1, further comprising an integral actuating media distribution system contained inside the single vertical body, the integral actuating media distribution system comprising:

a throttle valve that controls flow of pressurized actuating media into the percussion bore;

wherein the control valve further comprises an inlet port, a first outlet port, and a first exhaust port, wherein the control valve controls flow of pressurized actuating media into the upper lifting chamber of the first actuating bore;

a pressurized actuating media inlet duct in fluid communication with a source of pressurized actuating media and connected to the throttle valve and the inlet port of the control valve;

a first transport duct connecting the first outlet pod of the control valve to the upper lifting chamber of the first actuating bore;

wherein when the control valve is in the actuated position the inlet port of the control valve communicates with the first outlet pod of the control valve and pressurized actuating media flows through the first transport duct into the upper lifting chamber causing the first lift piston to move away from the upper lifting chamber and toward the lower retracting chamber.

3. The integrated percussion power tool and lift assist of claim 2, wherein the control valve further comprises a second outlet port and a second exhaust port, and wherein the integral actuating media distribution system further comprises:

a second transport duct connecting the second outlet port of the control valve to the lower retracting chamber of the first actuating bore;

wherein when the control valve is in the actuated position, the second outlet port of the control valve communicates with the second exhaust port of the control valve and actuating media flows out of the lower retracting chamber through the second transport duct and out of the second exhaust port of the control valve as actuating media in the upper lifting chamber causes the first lift piston to move away from the upper lifting chamber and toward the lower retracting chamber; and wherein when the control valve is in the normal position, the inlet port of the control valve communicates with the second outlet port of the control valve, and the first outlet port of the control valve communicates with the first exhaust port of the control valve, whereby actuating media flows out of the upper lifting chamber through the first transport duct and out of the first exhaust port of the control valve as actuating media flows through the second transport duct and into the lower retracting chamber causing the first lift piston to move away from the lower retracting chamber and toward the upper lifting chamber.

4. The integrated percussion power tool and lift assist of claim 1, wherein the first actuating bore is cylindrical.

5. The integrated percussion power tool and lift assist of claim 1, wherein the single vertical body further comprises a third integral longitudinal bore interior to the single vertical body, and wherein the third integral longitudinal bore is a second actuating bore.

6. The integrated percussion power tool and lift assist of claim 5, further comprising a second lift piston, wherein the second lift piston is contained within the second actuating bore of the single vertical body.

7. The integrated percussion power tool and lift assist of claim 6, wherein the first actuating bore and the second actuating bore are on opposite sides of the percussion bore, and wherein the first actuating bore and the second actuating bore are equidistant from the percussion bore.

* * * * *